US008227717B2

(12) United States Patent
Lu

(10) Patent No.: US 8,227,717 B2
(45) Date of Patent: Jul. 24, 2012

(54) KEY MECHANISM AND ELECTRONIC DEVICE USING THE SAME

(75) Inventor: Pen-Uei Lu, Tu-Cheng (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 262 days.

(21) Appl. No.: 12/713,273

(22) Filed: Feb. 26, 2010

(65) Prior Publication Data

US 2011/0094865 A1 Apr. 28, 2011

(30) Foreign Application Priority Data

Oct. 23, 2009 (TW) ..... 98135904 A

(51) Int. Cl.
*H01H 13/14* (2006.01)

(52) U.S. Cl. ..... 200/341

(58) Field of Classification Search ..... 200/302.2, 200/314, 5 A, 26, 341–345
See application file for complete search history.

(56) References Cited

U.S. PATENT DOCUMENTS

| | | | | |
|---|---|---|---|---|
| 6,617,535 | B2 * | 9/2003 | Lacroix | 200/339 |
| 7,094,983 | B2 * | 8/2006 | Tsunemoto | 200/339 |
| 7,554,050 | B1 * | 6/2009 | Lv | 200/339 |
| 2009/0052888 | A1 * | 2/2009 | Lee | 396/543 |

* cited by examiner

*Primary Examiner* — Briggitte R Hammond
(74) *Attorney, Agent, or Firm* — Altis Law Group, Inc.

(57) ABSTRACT

A key mechanism is used in an electronic device. The electronic device includes a housing defining an opening. The key mechanism includes: a plate, at least one latching portion positioned on a first side of the plate; at least one post positioned on a first side of the plate; and a protrusion extending from a second side opposite to the first side. The protrusion extends from the opening, the latching portion and the plate resist the housing. The present disclosure further discloses an electronic device using the key mechanism.

5 Claims, 4 Drawing Sheets

KEY MECHANISM AND ELECTRONIC DEVICE USING THE SAME

BACKGROUND

1. Technical Field

The present disclosure generally relates to key mechanisms, specifically to key mechanisms for electronic devices such as mobile phones.

2. Description of Related Art

With the development of wireless communication and information processing technologies, electronic devices, such as mobile telephones and electronic notebooks, are now widely used. These electronic devices enable consumers to enjoy high technology services, almost anytime and anywhere. Keys for inputting commands etc. are disposed on the devices but are often so small they are difficult to assemble.

Therefore, there is a room for improvement within the art.

BRIEF DESCRIPTION OF THE DRAWINGS

Many aspects of a key mechanism and electronic device using the same can be better understood with reference to the following drawings. The components in the drawings are not necessarily to scale, the emphasis instead being placed upon clearly illustrating the key mechanism and electronic device using the same. Moreover, in the drawings, like reference numerals designate corresponding parts throughout the several views.

DETAILED DESCRIPTION

Figure 1:
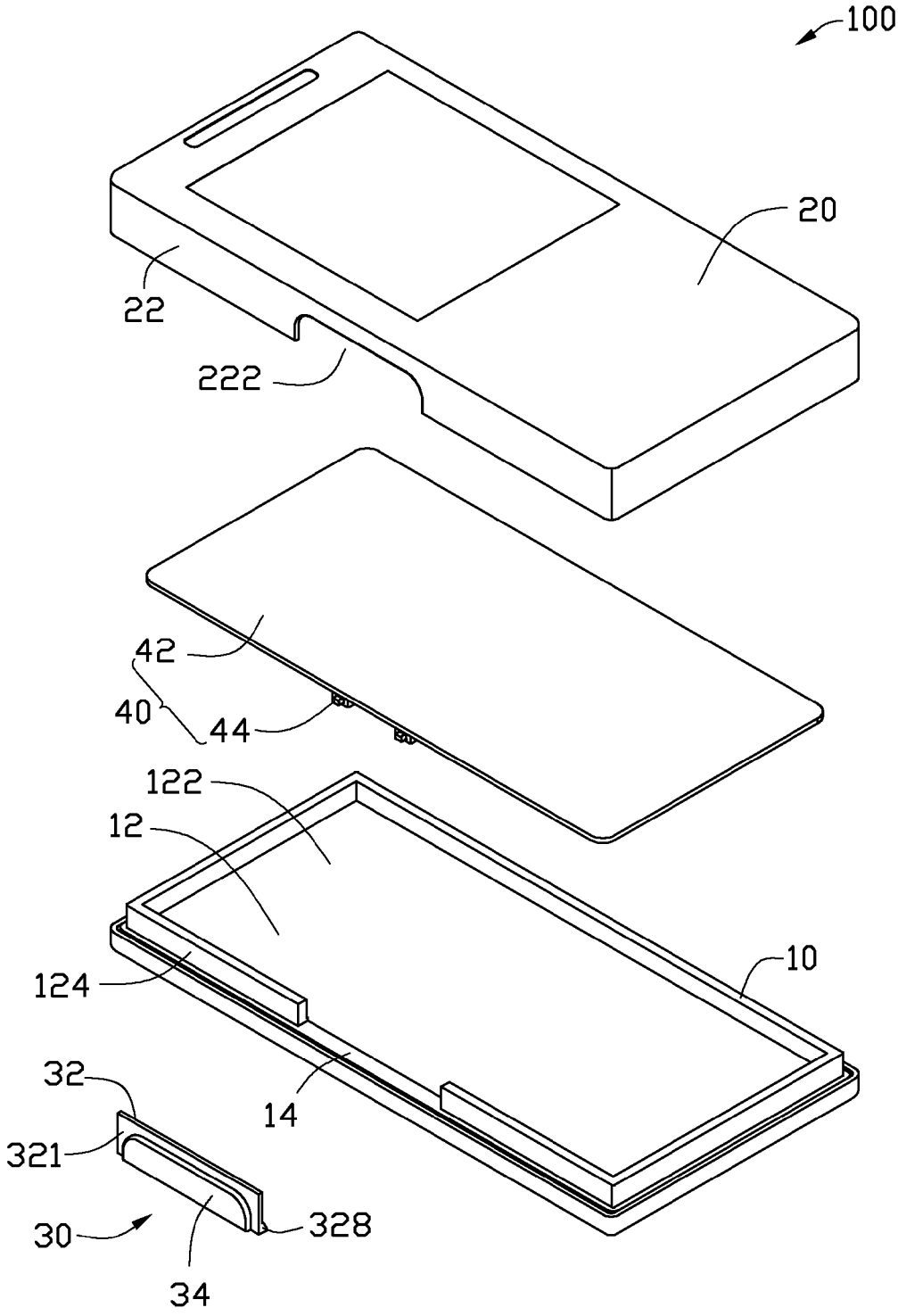
FIG. 1 is an exploded, isometric view of an exemplary electronic device.

FIG. 1 shows an exemplary key mechanism 30 used in an electronic device 100, such as mobile phone, personal digital assistant, and so on.

The electronic device 100 includes a main body 10, a cover 20 covering the main body 10, the key mechanism 30, and a printed circuit board 40. The key mechanism 30 is assembled to a side of the main body 10 for triggering the printed circuit board 40 to input some instruction into the electronic device 100.

The main body 10 defines a receiving chamber 12 configured for receiving the printed circuit board 40. The receiving chamber 12 includes a bottom wall 122 and a peripheral wall 124. The peripheral wall 124 defines an opening 14 configured for assembling the key mechanism 30.

Figure 3:
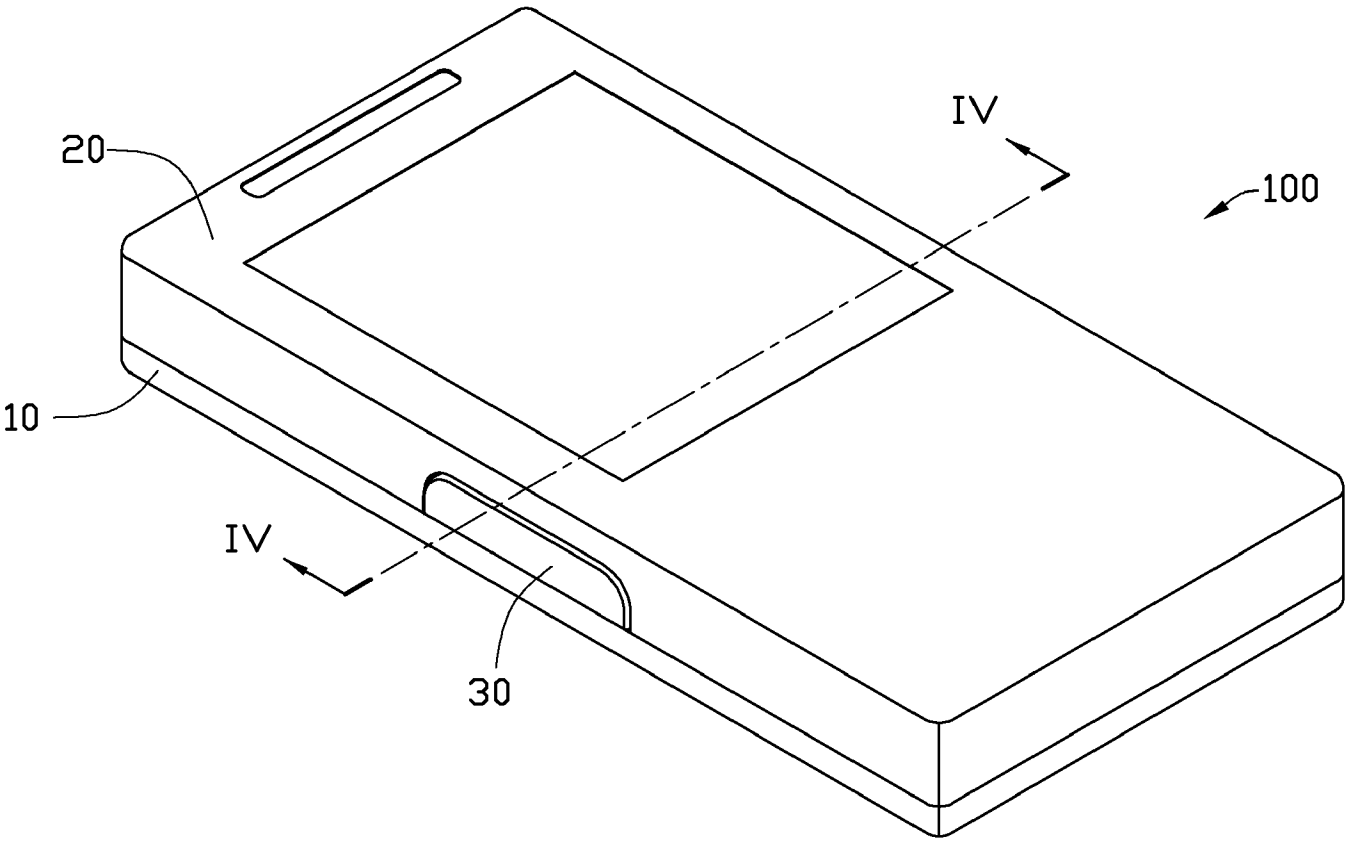
FIG. 3 is an assembled, isometric view of the exemplary electronic device.

The cover 20 includes a sidewall 22 defining a notch 222 and a groove 224 (shown in FIG. 4) surrounding the notch 222. Referring to FIG. 3, when the cover 20 is assembled to the main body 10, the notch 222 is aligned with the opening 14. Thus, the key mechanism 30 can be exposed from the cover 20. The groove 224 can receive a part of the key mechanism 30.

Figure 2:
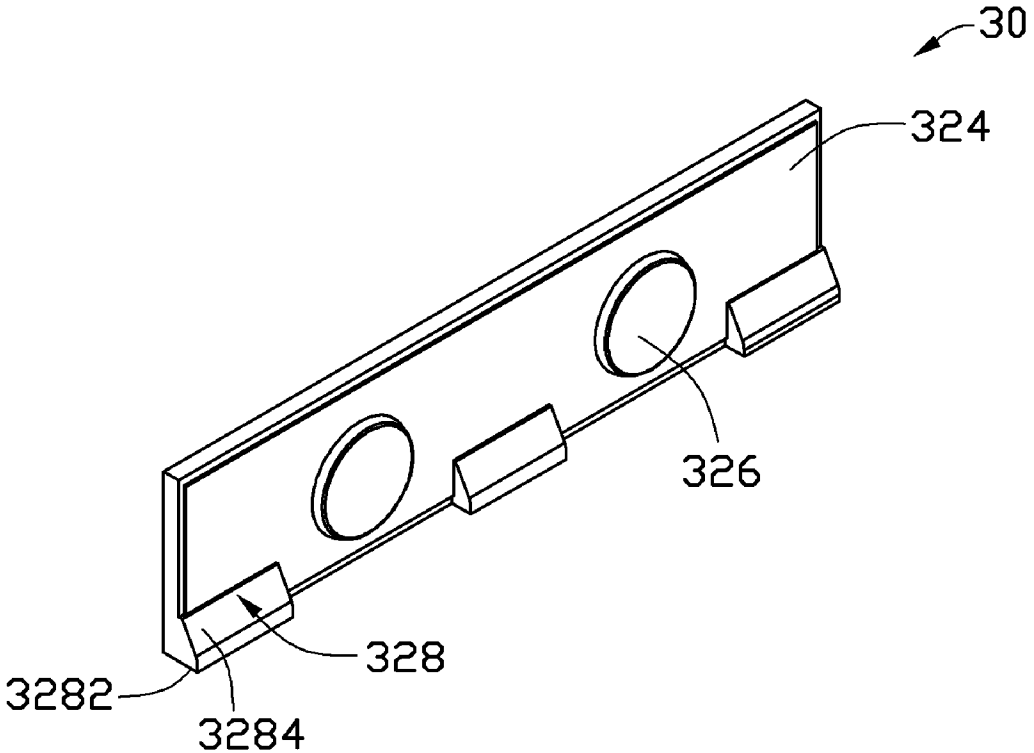
FIG. 2 is an enlarged view of a key mechanism shown in FIG. 1 from another aspect.

Referring to FIG. 2, the key mechanism 30 includes a plate 32, a protrusion 34, three latching portions 328, and two posts 326. The plate 32 includes a first surface 321 and an opposite second surface 323. The protrusion 34 extends from the first surface 321. The latching portions 328 are positioned on the second surface 323 and uniformly spaced from each other.

Each of the latching portions 328 includes a latching surface 3282 and an inclined surface 3284 connecting to the latching surface 3282. The latching surface 3282 is configured for abutting against the main body 10. A post 326 is respectively disposed between each pair of adjacent latching portions 328. The posts 326 are configured for triggering the printed circuit board 40.

The printed circuit board 40 includes a board body 42 and two contacting points 44 positioned on the board body 42. When the key mechanism 30 presses the contacting points 44, the printed circuit board 40 is triggered.

Figure 4:
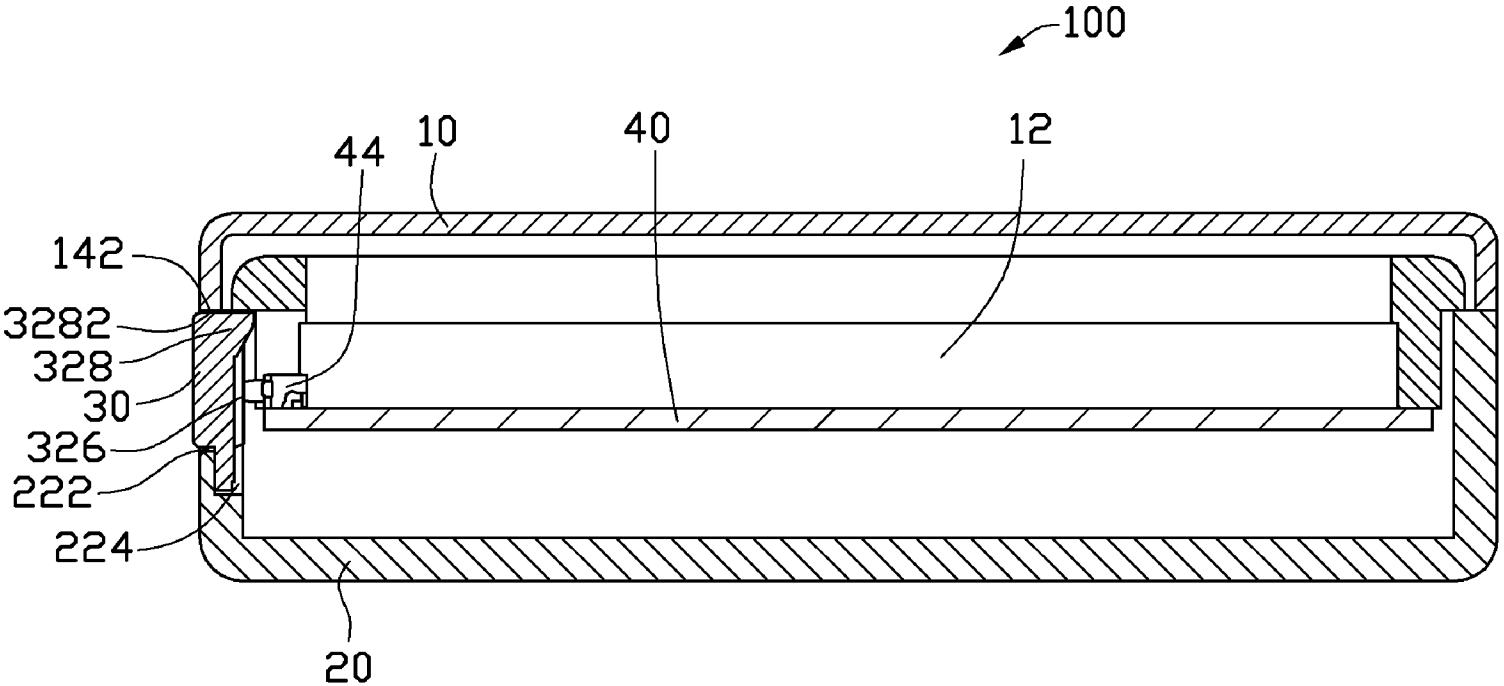
FIG. 4 is a cross-sectional view of the electronic device along line IV-IV.

Referring to FIG. 3 and FIG. 4, an exemplary embodiment of a method for assembling the electronic device 100 may include the following steps:

First, the printed circuit board 40 is positioned in the receiving chamber 12, and the contacting points 44 are aligned with the opening 14. Then, the cover 20 covers the main body 10, and the notch 222 is aligned with the opening 14. Thus, the contacting points 44 can exposed from the electronic device 100.

Second, the plate 32 is received in the groove 224 and the inclined surface 3284 resists against the main body 10. Then, when pressing the key mechanism 30, the inclined surface 3284 slides on the main body 10. When the inclined surface 3284 passes the opening 14, the latching surface 3282 resist the main body 10, and the protrusion 34 extends from the opening 14 and the notch 222. Thus, the key mechanism 30 is assembled in the electronic device 100.

It is to be understood, the main body 10 and the cover 20 may constitute a housing.

The key mechanism 30 has a simple structure and is easily assembled to the electronic device 100.

It is to be understood, however, that even through numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An electronic device, comprising:

a first member defining an opening;

a second member defining a notch and a groove communicating with each other, the second member attach to the first member, and the opening aligned with the notch;

a key mechanism, comprising:

a plate having first and second planar ends, first and second opposite side edges, and first and second opposite side surfaces;

at least one latching portion positioned on the first side surface of the plate, and coplanar with one of the first and second planar ends of the plate;

at least one post positioned on the first side surface of the plate; and a protrusion extending from the second side surface opposite to the first side surface; the protrusion extending from the opening of the first member and the notch of the second member, the first edge of the plate latched in the groove of the second member for preventing the plate from separating from the second member, the latching portion and the second side edge of the plate resisting the first member to assembly the key mechanism on the first member and the second member.

2. The electronic device as claimed in claim 1, wherein the latching portion comprises an inclined surface and a latching surface, when the key mechanism is pressed, the inclined surface slides on the first member until the latching surface abuts against the first member.

3. The electronic device as claimed in claim 1, wherein one side of the protrusion is coplanar with the second side edge of the plate, and the other side of the protrusion is spaced from the first side edge of the plate.

4. The electronic device as claimed in claim 1, wherein the key mechanism comprises three latching portions and two posts; the latching portions are positioned on the plate and uniformly spaced from each other, each post is respectively disposed between each pair of adjacent latching portions.

5. The electronic device as claimed in claim 4, further comprising a printed circuit board receiving in the housing, the printed circuit board comprises a board body and two contacting points positioned on the board body; the contacting points are exposed from the opening and triggered by the posts.

* * * * *